US008821357B2

(12) United States Patent
Reid

(10) Patent No.: US 8,821,357 B2
(45) Date of Patent: Sep. 2, 2014

(54) DUMBBELL CASTOR EXERCISE DEVICE

(71) Applicant: IsoShred Fitness, LLC, Maple Valley, WA (US)

(72) Inventor: Michael S. Reid, Lake Stevens, WA (US)

(73) Assignee: IsoShred Fitness, LLC, Maple Valley, WA (US)

( * ) Notice: Subject to any disclaimer, the term of this patent is extended or adjusted under 35 U.S.C. 154(b) by 0 days.

(21) Appl. No.: 13/871,736

(22) Filed: Apr. 26, 2013

(65) Prior Publication Data

US 2013/0237392 A1 Sep. 12, 2013

Related U.S. Application Data

(63) Continuation of application No. 13/459,087, filed on Apr. 28, 2012.

(60) Provisional application No. 61/488,740, filed on May 21, 2011.

(51) Int. Cl.

| | |
|---|---|
| ***A63B 21/00*** | (2006.01) |
| ***A63B 21/072*** | (2006.01) |
| ***A63B 21/075*** | (2006.01) |
| ***A63B 22/20*** | (2006.01) |
| ***A63B 23/12*** | (2006.01) |

(52) U.S. Cl.

CPC ..... *A63B 21/0726* (2013.01); *A63B 22/20* (2013.01); *A63B 23/1236* (2013.01); *A63B 22/203* (2013.01)

USPC ..... 482/108; 482/131; 482/132

(58) Field of Classification Search

CPC .. A63B 21/072; A63B 21/0726; A63B 22/20; A63B 22/203; A63B 23/02; A63B 23/0205; A63B 23/1236; A63B 23/1245

USPC ..... 482/50, 104–107, 132, 136, 141, 44, 482/49, 92, 93, 108, 131; 301/5.23

See application file for complete search history.

(56) References Cited

U.S. PATENT DOCUMENTS

| | | | | |
|---|---|---|---|---|
| 3,363,735 | A * | 1/1968 | Hotchkiss | 193/37 |
| 3,622,152 | A | 11/1971 | Place | |
| 3,789,947 | A * | 2/1974 | Blumrich | 180/6.48 |
| 3,809,393 | A * | 5/1974 | Jones | 482/132 |
| 4,892,305 | A * | 1/1990 | Lynch | 482/132 |
| D309,254 | S * | 7/1990 | Guile | D8/375 |
| 5,064,045 | A * | 11/1991 | Leon | 193/35 MD |
| 6,857,707 | B2 * | 2/2005 | Guile | 301/5.23 |
| 7,011,610 | B2 * | 3/2006 | Wawrzyniak | 482/106 |
| 7,566,102 | B2 | 7/2009 | Guile | |
| 7,621,858 | B2 | 11/2009 | Sheron | |

(Continued)

OTHER PUBLICATIONS

U.S. Appl. No. 13/459,087 Official Communication mailed Aug. 28, 2013.

*Primary Examiner* — Loan H Thanh
*Assistant Examiner* — Nyca T Nguyen
(74) *Attorney, Agent, or Firm* — Lowe Graham Jones PLLC

(57) ABSTRACT

A dumbbell caster assembly includes a first omnidirectional wheel assembly mechanically coupled to a grip. A second omnidirectional wheel assembly is mechanically coupled to the grip. The omnidirectional wheel assemblies can include a plurality of wheel sub-wheels. The dumbbell caster assembly allows a user to perform exercises, such as push-up exercises and abdominal exercises, that require omnidirectionality.

12 Claims, 2 Drawing Sheets

(56) References Cited

U.S. PATENT DOCUMENTS

| | | | |
|---|---|---|---|
| 7,935,039 | B2 | 5/2011 | Dannenberg |
| D654,545 | S | 2/2012 | Richard |
| 2010/0130337 | A1 | 5/2010 | Stewart |
| 2013/0012369 | A1 | 1/2013 | Prest |
| 2013/0023391 | A1 | 1/2013 | Nicholas |

* cited by examiner

DUMBBELL CASTOR EXERCISE DEVICE

CROSS-REFERENCE TO RELATED APPLICATIONS

This patent application is a continuation of U.S. patent application Ser. No. 13/459,087 filed on Apr. 28, 2012, which claims priority to U.S. Provisional Patent Application No. 61/488,740 filed on May 21, 2011, all of which are incorporated herein by reference.

FIELD OF THE INVENTION

This invention relates to exercise equipment.

BACKGROUND OF THE INVENTION

In the fitness equipment industry there are many different types of push up exercise devices that seek to improve the overall effectiveness of a push-up exercise. There are also devices that seek to improve on abdominal exercises. Some of the push-up exercise devices move from side to side or rotate about a vertical axis in order to increase the resistance of a push up exercise. There are also abdominal exercise devices that roll to improve the effectiveness and increase the resistance of abdominal exercises. However, there is a current need for a push up exercise device and an abdominal exercise device that allows for movement in all directions and while providing rotation thereby improving the effectiveness of a push-up exercise and an abdominal exercise in one device.

BRIEF SUMMARY OF THE INVENTION

A dumbbell caster assembly comprises a first omnidirectional wheel assembly mechanically coupled to a grip. A second omnidirectional wheel assembly is mechanically coupled to the grip.

BRIEF DESCRIPTION OF THE SEVERAL VIEWS OF THE DRAWINGS

Figure 1:
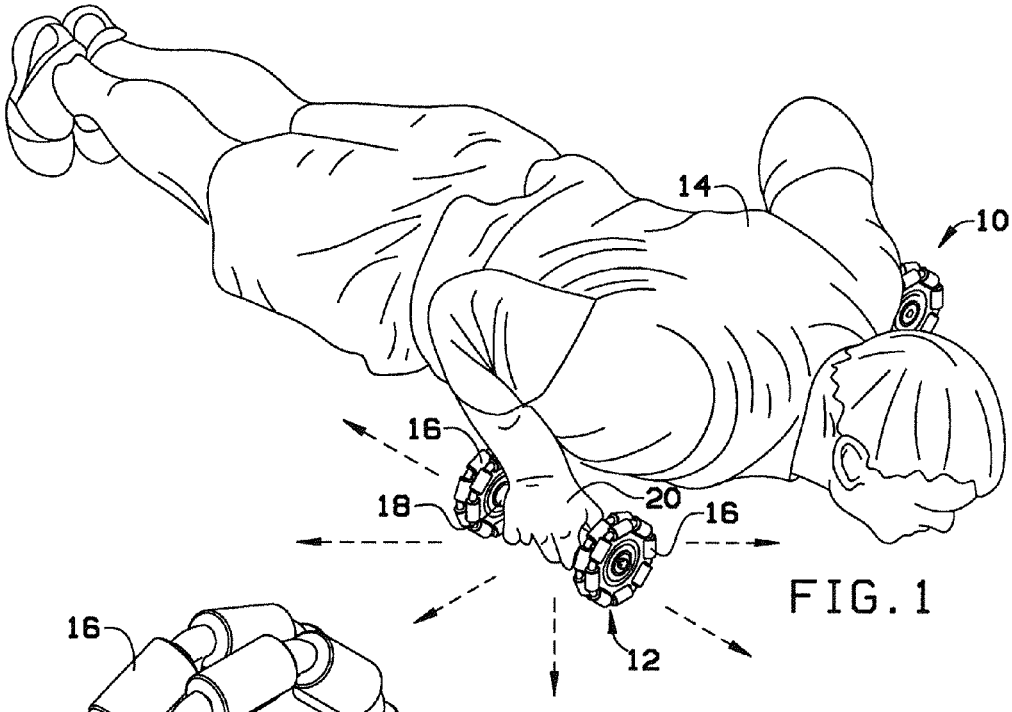

Having thus described the invention in general terms, reference will now be made to the accompanying drawings, which are not necessarily drawn to scale, and wherein:

FIG. 1 is a perspective view of the invention shown in use.

Figure 2:
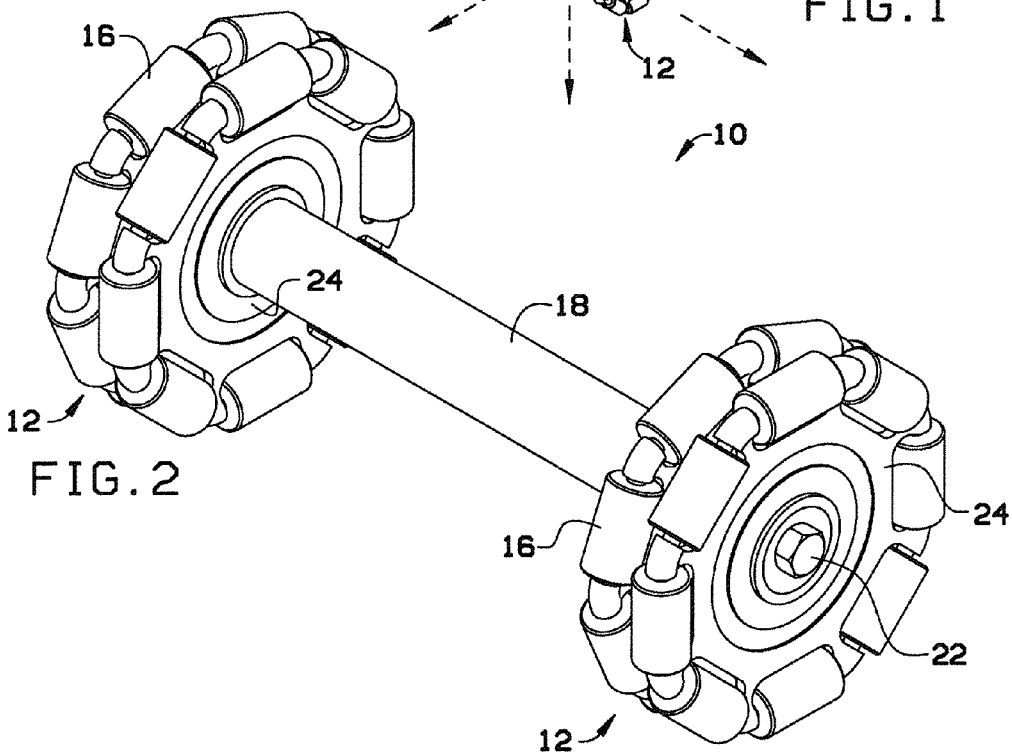

FIG. 2 is a perspective view of the invention.

Figures 3, 4:
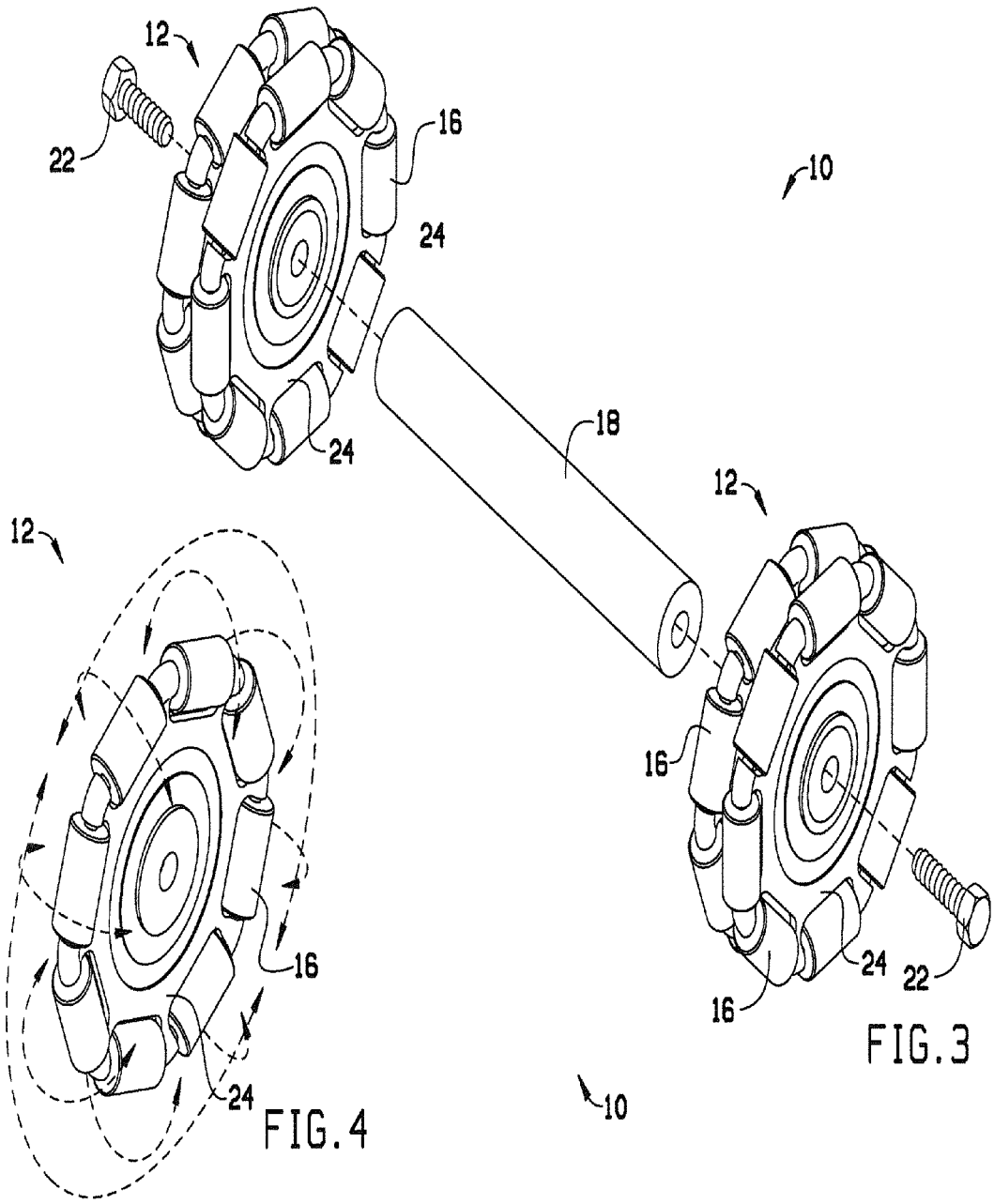

FIG. 3 is an exploded view of the invention

FIG. 4 is a perspective detail view of the invention intentionally illustrating half of the omnidirectional wheel assembly for clarity.

DETAILED DESCRIPTION OF THE INVENTION

Embodiments of the present invention overcome many of the obstacles associated with a push-up device that can also function as abdominal device, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. User 14 desires to do push-up exercises using hands 20, which will strengthen the user's chest, the user's abdomen or both. User 14 accomplishes this with dumbbell castor assembly 10. Dumbbell castor assembly 10 comprises a first omnidirectional wheel assembly 12, a second omnidirectional wheel assembly 12, a third omnidirectional wheel assembly 12 and a fourth omnidirectional wheel assembly 12 which further comprises omnidirectional wheel sub-wheel 16. The first omnidirectional wheel assembly 12, the second omnidirectional wheel assembly 12, the third omnidirectional wheel assembly 12 and the fourth omnidirectional wheel assembly 12 are mechanically coupled to grip 18 as shown in FIG. 3.

FIG. 2 shows dumbbell castor assembly 10 in more detail. Omnidirectional wheel assembly 12 comprises omnidirectional wheel sub-wheel 16 and omnidirectional wheel drum 24. The first omnidirectional wheel assembly 12, the second omnidirectional wheel assembly 12, the third omnidirectional wheel assembly 12 and the fourth omnidirectional wheel assembly 12 are mechanically coupled to grip 18 with fastener 22 as shown in FIG. 3. Similarly, the first omnidirectional wheel assembly 12 comprises a first omnidirectional wheel sub-wheel 16, the second omnidirectional wheel assembly 12 comprises a second omnidirectional wheel sub-wheel 16, the third omnidirectional wheel assembly 12 comprises a third omnidirectional wheel sub-wheel 16 and the fourth omnidirectional wheel assembly 12 comprises a fourth omnidirectional wheel sub-wheel 16.

FIG. 3 shows index loaded assembly drawing of dumbbell castor assembly 10. Omnidirectional wheel assembly 12 is mechanically coupled to grip 18 by fastener 22. As noted in FIG. 4, this construction technique allows for omnidirectional movement of dumbbell castor assembly 10. While four omnidirectional wheel assemblies 12 are shown in the figure in the construction can be done with any number of omnidirectional wheel assembly 12 combinations. These components can be made from a large number of materials including steel, aluminum, stainless steel, wood, plastic or any other material.

FIG. 4 displays the omnidirectional nature of omnidirectional wheel assembly 12. Note that omnidirectional wheel drum 24 enables omnidirectional wheel assembly 12 to rotate in the horizontal direction. Similarly, omnidirectional wheel sub-wheel 16 enables omnidirectional wheel assembly 12 to rotate in a vertical direction. These two movements work in conjunction to allow dumbbell castor assembly 10 to be used as an abdominal exercise device or a push-up exercise device.

That which is claimed:

1. A dumbbell caster assembly comprising
- a first omnidirectional wheel assembly,
- a second omnidirectional wheel assembly,
- a third omnidirectional wheel assembly,
- a fourth omnidirectional wheel assembly, and
- a grip comprising
  - a first end, a second end, and a longitudinal axis;
- wherein
  - each omnidirectional wheel assembly comprises a wheel drum having a circumference and a center and a plurality of wheel sub-wheels disposed around the circumference of the wheel drum;
- the centers of the first and third wheel drums are mechanically coupled to the first end of the grip;
- the centers of the second and fourth wheel drums are mechanically coupled to the second end of the grip;
- the first and third omnidirectional wheel assemblies are separated from the second and fourth omnidirectional wheel assemblies by the grip;
- each wheel drum of each omnidirectional wheel assembly has an axis of rotation that is about and around the longitudinal axis of the grip;

each sub-wheel of each omnidirectional wheel assembly has an axis of rotation that is orthogonal to the axis of rotation of the wheel drum of each omnidirectional wheel assembly;

the first and third omnidirectional wheel assemblies are aligned such that each subwheel of the first omnidirectional wheel assembly is disposed between two sub-wheels of the third omnidirectional wheel assembly; and the second and fourth omnidirectional wheel assemblies are aligned such that each sub-wheel of the second omnidirectional wheel assembly is disposed between two sub-wheels of the fourth omnidirectional wheel assembly.

2. The dumbbell caster assembly of claim 1, wherein all of the wheel drums of the dumbbell caster assembly have the same diameter.

3. The dumbbell caster assembly of claim 2, wherein all of the wheel drums of the dumbbell caster assembly have the same size dimensions.

4. The dumbbell caster assembly of claim 1, wherein the first and third omnidirectional wheel assemblies are aligned such that each subwheel of the first omnidirectional wheel assembly is centered between two subwheels of the third omnidirectional wheel assembly; and the second and fourth omnidirectional wheel assemblies are aligned such that each sub-wheel of the second omnidirectional wheel assembly is centered between two sub-wheels of the fourth omnidirectional wheel assembly.

5. The dumbbell caster assembly of claim 1, wherein all of the sub-wheels of the dumbbell caster assembly have the same size dimensions.

6. The dumbbell caster assembly of claim 1, wherein each omnidirectional wheel assembly has the same number of sub-wheels.

7. The dumbbell caster assembly of claim 1, wherein the grip is cylindrical.

8. A method of exercising comprising rotating the wheels drums and the sub-wheels of the dumbbell caster assembly of claim 1.

9. The dumbbell caster assembly of claim 1, wherein the dumbbell caster assembly allows for movement in all directions on a surface by a user.

10. A dumbbell caster assembly comprising a first omnidirectional wheel assembly, a second omnidirectional wheel assembly, a third omnidirectional wheel assembly, a fourth omnidirectional wheel assembly, and a cylindrical grip comprising a first end, a second end, and a longitudinal axis;

wherein each omnidirectional wheel assembly comprises a wheel drum having a circumference and a center and a plurality of wheel sub-wheels disposed around the circumference of the wheel drum;

all of the sub-wheels have the same size dimensions;

all of the wheel drums have the same size dimensions;

each omnidirectional wheel assembly has the same number of sub-wheels;

the centers of the first and third wheel drums are mechanically coupled to the first end of the grip;

the centers of the second and fourth wheel drums are mechanically coupled to the second end of the grip;

the first and third omnidirectional wheel assemblies are separated from the second and fourth omnidirectional wheel assemblies by the grip;

each wheel drum of each omnidirectional wheel assembly has an axis of rotation that is about and around the longitudinal axis of the grip;

each sub-wheel of each omnidirectional wheel assembly has an axis of rotation that is orthogonal to the axis of rotation of the wheel drum of each omnidirectional wheel assembly;

the first and third omnidirectional wheel assemblies are aligned such that each subwheel of the first omnidirectional wheel assembly is centered between two subwheels of the third omnidirectional wheel assembly; and the second and fourth omnidirectional wheel assemblies are aligned such that each sub-wheel of the second omnidirectional wheel assembly is centered between two sub-wheels of the fourth omnidirectional wheel assembly.

11. A method of exercising comprising rotating the wheels drums and the sub-wheels of the dumbbell caster assembly of claim 10.

12. The dumbbell caster assembly of claim 10, wherein the dumbbell caster assembly allows for movement in all directions on a surface by a user.

* * * * *